US005274423A

United States Patent [19]

Kusumoto

[11] Patent Number: 5,274,423

[45] Date of Patent: Dec. 28, 1993

[54] IMAGE FORMING APPARATUS HAVING TEMPERATURE CONTROL AT A FIXING UNIT

[75] Inventor: Keiji Kusumoto, Azuchi, Japan

[73] Assignee: Minolta Camera Kabushiki Kaisha, Osaka, Japan

[21] Appl. No.: 958,488

[22] Filed: Oct. 8, 1992

Related U.S. Application Data

[63] Continuation of Ser. No. 607,763, Oct. 30, 1990, abandoned, which is a continuation of Ser. No. 333,919, Apr. 6, 1989, abandoned.

[30] Foreign Application Priority Data

Apr. 8, 1988 [JP] Japan ..... 63-87572
Apr. 12, 1988 [JP] Japan ..... 63-90036

[51] Int. Cl.[5] ..... G03G 15/20; G03G 21/00

[52] U.S. Cl. ..... 355/208; 355/282

[58] Field of Search ..... 355/206, 208, 282, 285, 355/286

[56] References Cited

U.S. PATENT DOCUMENTS

| | | | |
|---|---|---|---|
| 3,936,658 | 2/1976 | Traister et al. | 219/216 |
| 4,415,800 | 11/1983 | Dodge et al. | 355/206 X |
| 4,471,210 | 9/1984 | van den Eijnden | 355/285 X |
| 4,538,902 | 9/1985 | Inuzuka et al. | 355/206 X |
| 4,541,708 | 9/1985 | Shigenobu | 355/286 |
| 4,551,007 | 11/1985 | Elter | 355/286 |
| 4,609,278 | 9/1986 | Taniguchi | 355/285 |
| 4,745,430 | 5/1988 | Tsuchiya | 219/216 X |
| 4,778,980 | 10/1988 | Rathbun | 219/216 X |
| 4,801,974 | 1/1989 | Suto et al. | 219/216 X |
| 4,821,062 | 4/1989 | Katoh et al. | 355/285 X |
| 4,821,069 | 4/1989 | Kusumoto | 355/285 X |
| 4,968,872 | 11/1990 | Kusumoto | 355/290 X |
| 4,994,852 | 2/1991 | Matsuuchi et al. | 355/206 |
| 5,032,874 | 7/1991 | Matsuuchi | 355/285 |

FOREIGN PATENT DOCUMENTS

| | | | |
|---|---|---|---|
| 95247 | 8/1981 | Japan . | |
| 56-161558 | 12/1981 | Japan . | |
| 60-115977 | 6/1985 | Japan . | |
| 61-102675 | 5/1986 | Japan . | |
| 62-195876 | 8/1987 | Japan . | |
| 62-285101 | 12/1987 | Japan | 355/208 |

*Primary Examiner*—Fred L. Braun
*Attorney, Agent, or Firm*—Burns, Doane, Swecker & Mathis

[57] ABSTRACT

The present invention relates to an image forming apparatus such as a copying machine and the like, and more in particular to the temperature control at a fixing unit thereof. In the image forming apparatus according to the present invention, the temperature of the fixing unit is controlled to be kept at the first set point by the processor in normal operation, and when the temperature of the fixing unit rises to come to reach the second set point as a result of the troubles in the processor, the temperature is made to drop by resetting the processor or by cutting off the current to the fixing unit by the function of the breaking circuit of the current from the power source. Consequently, the temperature of the fixing unit never rises even when the processor gets out of order. As a result, it is possible not only to prevent thermal damages of parts caused by temperature rise at the fixing unit, but also to aim at improving the quality of prints as well as carrying out power saving.

13 Claims, 6 Drawing Sheets

IMAGE FORMING APPARATUS HAVING TEMPERATURE CONTROL AT A FIXING UNIT

This application is a continuation of application Ser. No. 07/607,763, filed Oct. 30, 1990, now abandoned which is a continuation of Ser. No. 07/333,919, which was filed on Apr. 6, 1989, now abandoned.

BACKGROUND OF THE INVENTION

1. Field of the Invention

The present invention relates to an image forming apparatus such as a copying machine and the like, and more in particular, to the temperature control at the fixing unit where a toner image transferred onto a paper or the like is dissolved and fixed.

2. Description of the Related Art

The fixing unit of a copying machine is a unit where a toner image fed from a photosensitive drum and transferred onto a paper is dissolved and fixed onto the paper by fixing rollers. For this purpose, the fixing rollers are provided with a heater lamp for heating.

The fixing rollers are controlled to be kept at temperature previously set according to the size and thickness of the paper, or to circumstances whether the copying machine is in a ready state or in operation, for example. This control is carried out by detecting the temperature on the fixing roller by means of a thermister or the like, and then by lighting and putting out the heater lamp.

Such a temperature control at the fixing unit as mentioned above makes it possible to bring about improvement of the quality of prints as well as power saving. Therefore, delicate temperature control is desirable.

For this purpose, some machines have recently appeared wherein it is possible to carry out delicate temperature control by inputting temperature-detecting signals from a thermister or the like in the analogue port of a microcomputer as control section and by carrying out the temperature control through software.

In the temperature control through software, however, the fixing unit suffers from abnormally high temperature in a case where software has got out of order by unexpected noises or the like to keep the heater lamp turned on. So a temperature fuse is installed as a means for preventing finally occurrences of fires or the like. But there is a danger of deformations being caused in parts such as gears and the like of synthetic resin to bring about serious, mechanical damages, before the fuse is disabled.

Therefore, it can be thought to use a temperature fuse with a low melting point. Such a fuse, however, is disabled at a low point every time abnormal state as mentioned above is brought about, accordingly, there often arises need for replacement of fuses, which is troublesome.

SUMMARY OF THE INVENTION

The present invention has been made in order to solve the aforementioned problem. In an image forming apparatus according to the present invention, the temperature of a fixing unit is controlled to be kept normally at a first set point by means of a processor. When the temperature of the fixing unit reaches a second set point due to troubles such as the processor's getting out of order or the like, a switch provided in the power source circuit of the fixing unit is made to open by the function of the breaking circuit of the current from the power source to break the current from the power source of the fixing unit or the processor is reset to the initial state by the function of the reset circuit.

A first object of the present invention is to provide an image forming apparatus wherein it is possible to prevent the fixing unit from suffering from abnormally high temperature.

A second object of the present invention is to provide an image forming apparatus wherein there is no fear of the parts suffering from thermal damages.

A third object of the present invention is to provide an image forming apparatus wherein it is possible to aim at improving the quality of prints as well as carrying out power saving.

The above and further objects and features of the invention will more fully be apparent from the following detailed description with accompanying drawings.

DESCRIPTION OF THE PREFERRED EMBODIMENTS

Figure 1:
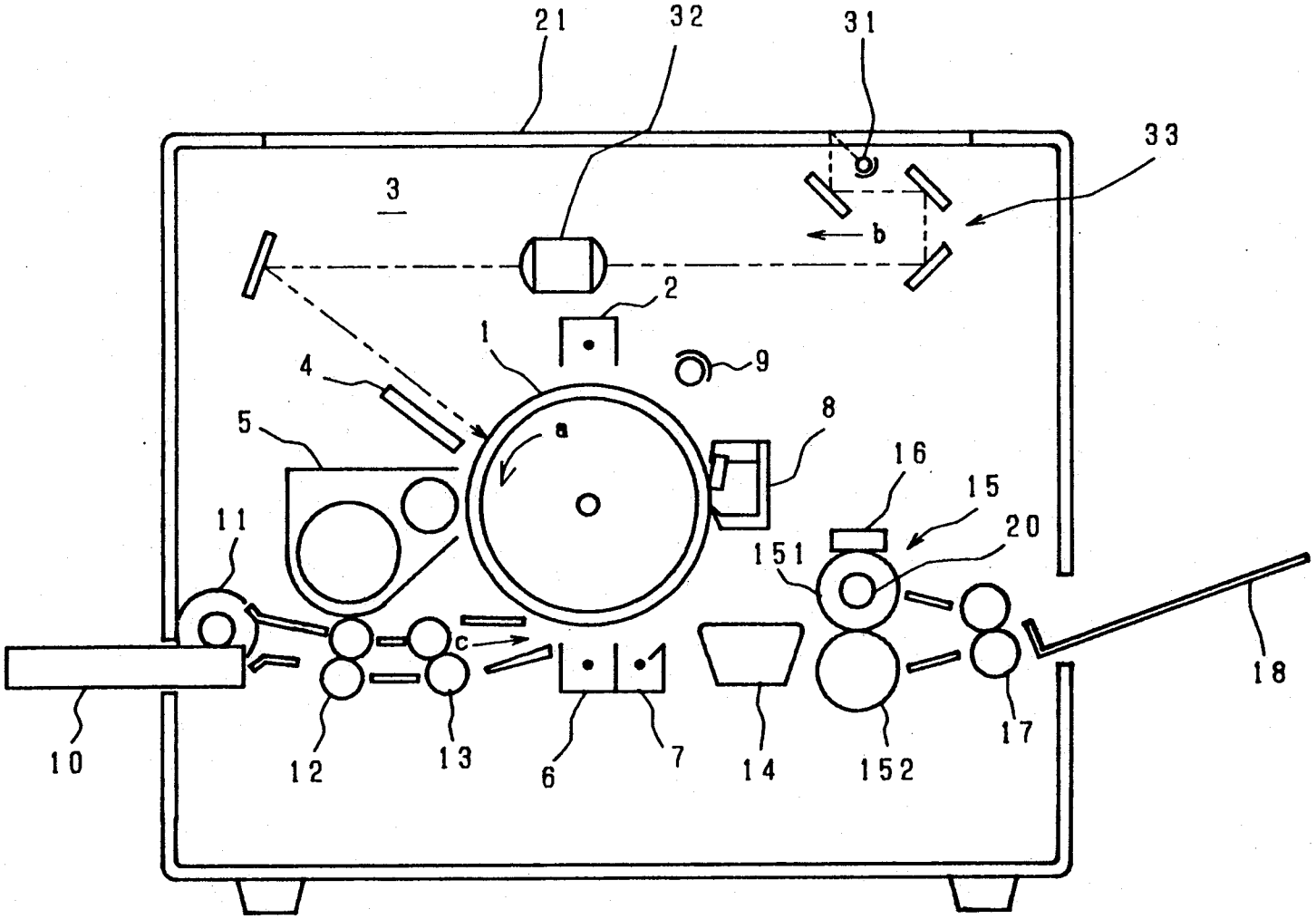
FIG. 1 is a schematic view showing the inner structure of an image forming apparatus (a copying machine) according to the present invention.

The present invention will be described with reference to the drawings showing one embodiment of a copying machine according thereto. In FIG. 1, the numeral 1 denotes a photosensitive drum which has a photoconductive layer on the outer peripheral surface thereof and is capable of rotation-driving in the direction shown by an arrow a. Above the photosensitive drum 1, a character 2 is disposed, which gives a predetermined quantity of charges (positive charges in the present embodiment) to the surface of the photosensitive drum 1.

An image exposure device 3 is installed under a document table 21. The image exposure device 3 comprises a group of mirrors 33, an exposure lamp 31, a lens 32 and the like, moving in the direction shown by an arrow b, and forms on the surface of the photosensitive drum 1 an electrostatic latent image corresponding to the document placed on the document table 21. A LED array 4 and a developing device 5 are installed at positions in the direction of rotation of the photosensitive drum 1 with respect to the charger 2 in order of the direction of rotation. The LED array 4 has a function to remove the charges at irrelevant portions, so called a function to erase space-between-images or margin-of-images, in order to prevent adhesion of excessive toner at the developing device 5. The developing device 5 makes the electrostatic latent image on the surface of the photosensitive drum 1 by the magnetic brush method into a toner image. A transferring charger 6 is installed below the photosensitive drum 1. The transferring charger 6 gives an electric field to a paper (not shown in the drawings) fed in the direction shown by an arrow c from the reverse side thereof, and transfers the toner image formed on the surface of the photosensitive drum 1 onto the paper. A separating charger 7 is disposed in the direction of rotation of the photosensitive drum 1 with respect to the transferring charger 6. The separating charger 7 removes the charges from the paper by giving it immediately after transferring an AC electric field and separates it from the surface of the photosensitive drum 1.

A cleaning device 8 is disposed in the direction of rotation of the photosensitive drum 1 with respect to the separating charger 7. The cleaning device removes the toner remained on the surface of the photosensitive drum 1 by the blade method. An eraser lamp 9 is disposed at a position between the cleaning device 8 and the charger 2. The eraser lamp 9 removes the charges remained on the surface of the photosensitive drum 1 by photoradiation in order to prepare for the next copying treatment.

The numeral 10 denotes a cassette where the papers are housed and this cassette 10 is capable of mounting to and demounting from the copying machine main unit. The cassette 10 is provided with a paper feed roller 11 for feeding out papers. The paper fed out from the cassette 10 is fed to a region between the photosensitive drum 1 and the transferring charger 6, as shown by an arrow c, via intermediary rollers 12 with a timing controlled by timing rollers 13. There the toner image is transferred onto the paper, and thus transferred paper is fed into a fixing unit 15 by means of a carrying belt 14.

The fixing unit 15 comprises an upper fixing roller 151, a lower fixing roller 152, a heater lamp 20 which is built in the upper fixing roller 151 and the like. A thermister 16 is disposed at the top of the upper fixing roller 151 for detecting the temperature thereof. The toner image which has been transferred onto the paper is dissolved and fixed by fixing rollers 151 and 152, and then the paper is discharged on a copy receiving tray 18 by discharging rollers 17.

Figure 2:
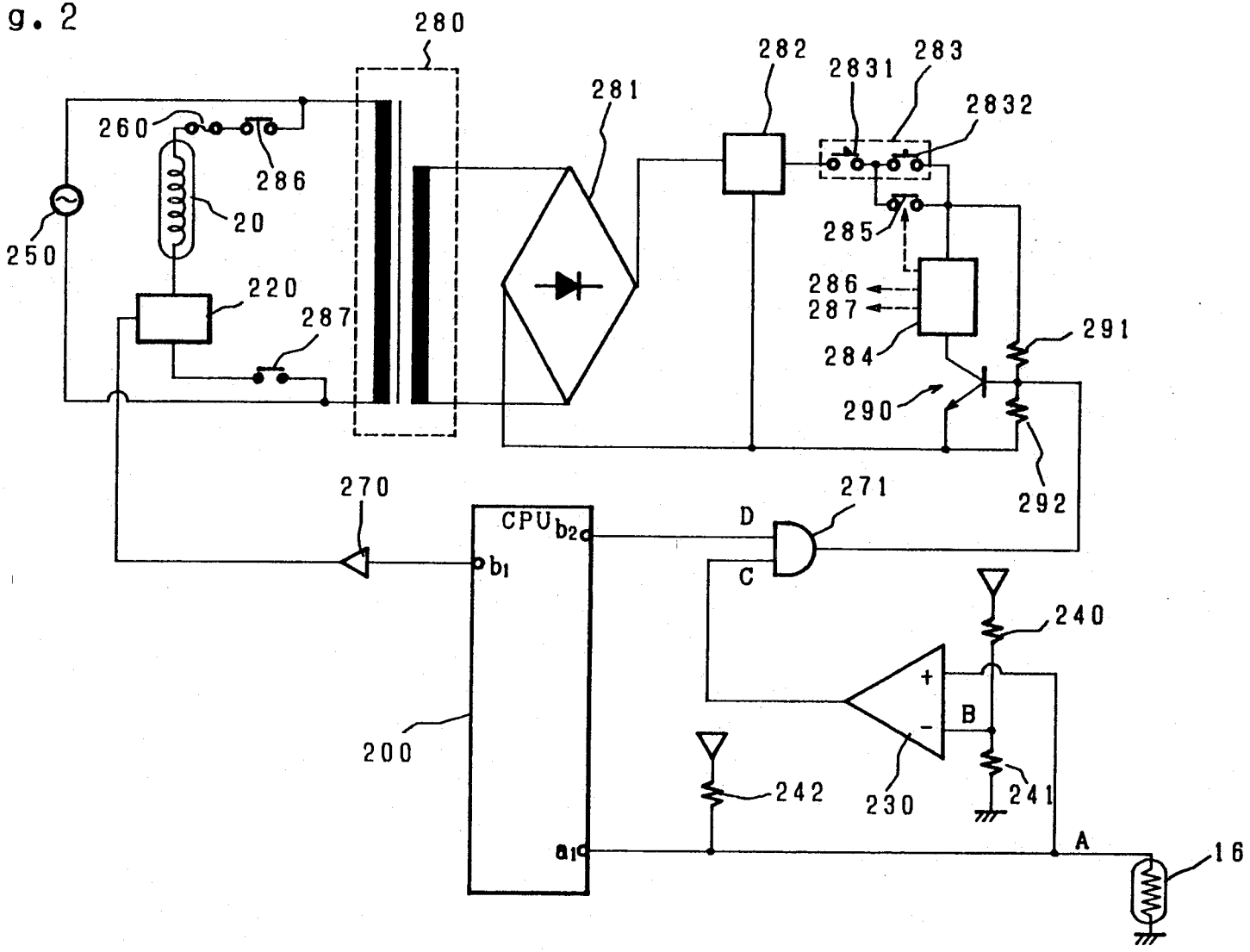
FIG. 2 is a block diagram of a principal part of the control circuits of an image forming apparatus (a copying machine) according to the present invention.

FIG. 2 is a block diagram of a principal part of the control circuits of an image forming apparatus according to the present invention. The numeral 200 denotes a CPU, that is, said processor which is the control nucleus of the apparatus according to the present invention, and an A/D converter is integrally formed therein. The intermediate potential at a voltage-dividing circuit is inputted in an analogue input port $a_1$ of the CPU 200 and a non-reverse input terminal of a comparator 230 respectively as the detecting signal A of the thermister 16. Into said voltage-dividing circuit, connected are a resistor 242 on the power source side and said thermister 16 on the ground side. A prescribed voltage B divided by resistors 240 and 241 is applied to a reverse input terminal of the comparator 230. The voltage B corresponds to a prescribed temperature of the upper fixing roller 151 which will be described later, that is, $T_2$ which is a temperature at a level higher (hereinafter called a second set point) than a fixing control temperature (hereinafter called a first set point) $T_1$ through software loaded in the CPU 200.

An output signal C of the comparator 230 is inputted in one terminal of an AND circuit 271, and an output signal D of an output port $b_2$ of the CPU 200 is inputted in the other input terminal thereof.

To a single-phase AC power source (hereinafter called the power source) 250 connected are a circuit wherein a normally open contact 286 of a power relay 284 which will be described later, a temperature fuse 260, the fixing heater lamp 20, a solid state relay (hereinafter abbreviated SSR) 220 and another normally open contact 287 of said power relay 284 are sequentially connected in series, and the primary winding of a transformer 280 in parallel. An output port $b_1$ of the CPU 200 is connected to a control terminal of said SSR 220 via a driving circuit 270. The output of the output port $b_1$ of the CPU 200 to turn on and turn off the SSR 220, which is designed to turn on when the output port $b_1$ comes to be at a low level. The temperature fuse 260 is disposed near the upper fixing roller 151 for the purpose of preventing occurrence of fire or the like in the case where the temperature of the fixing unit 15 rises abnormally due to an unexpected accident. The melting temperature of the temperature fuse 260 is set at a high point where it will not be disabled under normal copying operation, for example, at 300° C.

The secondary winding of said transformer 280 is connected to a rectification diode bridge 281, and supplies a DC voltage via a three-terminal regulator 282 to a circuit for controlling said power relay 284, that is, said breaking circuit of the current from the power source.

To the anode terminal of the power relay 284 connected is a recoil contact 2832 side of a main switch 283 of the copying machine in which a lock contact 2831 and the recoil contact 2832 are connected in series. At the same time, to said anode terminal of the power relay 284 connected is one end of a normally open contact 285 of the power relay 284, too. In this connection, the other end of said normally open contact 285 of the power relay 284 is connected between the lock contact 2831 and the recoil contact 2832. In this way, a self-retaining circuit is formed. The cathode terminal of the power relay 284 is connected to a collector terminal of a transistor 290, while an emitter terminal of said transistor 290 is connected to the cathode line of said rectification diode bridge 281. Connected to a base terminal of the transistor 290 are one end of the line provided with a resistor 291 with the other end thereof connected to the anode terminal of the power relay 284, as well as one end of the line provided with a resistor 292 with the other end thereof connected to the cathode line of the rectification diode bridge 281 respectively. In addition, the output signal of said AND circuit 271 is also inputted in this base terminal.

In the control circuits as constructed in this way, first, the main switch 283 being turned on so as to turn on the power source of the copying machine, both the lock contact 2831 and the recoil contact 2832 are turned on and the power source is supplied to the power relay 284. At the same time, by applying the voltage divided by resistors 291 and 292 to the base terminal of the transistor 290, the transistor 290 is turned on and the power relay 284 is turned on. And even when the recoil contact 2832 remains open due to its recoiling, the normally open contact 285 remains closed as the power relay 284 is turned on. In this case the power relay 284 is self-retained at its on state.

On the other hand, the normally open contacts 286 and 287 also remain closed as a result of on state of the power relay 284. Consequently, the fixing heater lamp 20 is turned on when the SSR 220 is turned on.

The temperature control at the fixing unit 15 is carried out by allowing the SSR 220 to turn on or turn off so as to make the value of the detecting signal A of the thermister 16 converted to a digital value in the CPU 200 be in accordance with a first set point $T_1$. And according to it, the fixing heater lamp 20 is turned on or turned off. Moreover, it is constructed so that these operations are carried out when the output port $b_2$ of the CPU 200 is at a high level. In normal states as when the copying machine is in a ready state or when the copying machine is in operation, by allowing the output port $b_2$, that is, the output signal D to be at a high level, the output signal of an AND circuit 271 is at a high level by the output signal C of the comparator 230 which is also at a high level in normal states to turn on the transistor 290 and further the power relay 284, which results in that the power source is supplied to the fixing heater lamp 20. In this connection, the explanation is given in the following as to the reason why the output signal C of the comparator 230 is normally at a high level. As mentioned above, the voltage B which corresponds to a second set point $T_2$ is applied to the reverse input terminal of the comparator 230. Since this second set point $T_2$ is set at a point higher than the fixing control temperature in normal states of the copying machine, that is, said first set point $T_1$, higher is the voltage of the detecting signal A of the thermister 16 inputted in the non-reverse input terminal of the comparator 230 than said voltage B. In this connection, as an example, $T_1$ is near 170° C. and $T_2$ near 250° C.

When an abnormal state is brought about in the CPU 200, the output signal of the AND circuit 271 comes to be at a low level to turn off the transistor 290, and the power relay 284 comes to be off, by allowing the output port $b_2$ to be at a low level. As a result, normally open contacts 285, 286, 287 come to be in open state to break the supply of the current from the power source 250 to the fixing heater lamp 20.

When the output port $b_1$ is latched at a low level and the output port $b_2$ at a high level due to the abnormal state in the CPU 200, the fixing heater lamp 20 remains turned on, and when the temperature of the fixing heater lamp 20 rises up to a second set point $T_2$, that is, about at 250° C., the voltage of the detecting signal A of the thermister 16 comes to be lower than the voltage B applied to the reverse input terminal of the comparator 230. Consequently, the output signal C of the comparator 230 comes to be at a low level and the output signal of the AND circuit 271 at a low level. As a result, in the same way as mentioned above, the power relay 284 comes to be off to break the supply of the current from the power source to the fixing heater lamp 20, and the fixing heater lamp is turned off.

To be safe, the machine is designed not to allow the power relay 284 to be turned on before the voltage of the detecting signal A of the thermister 16 has come to be higher than the voltage B, that is, so long as the temperature of the fixing unit is higher than a second set point $T_2$, once the power relay 284 is turned off due to such an abnormal state. And even in such a case, the power relay 284 can be turned on only when the main switch 283 is newly turned on.

Figure 3:
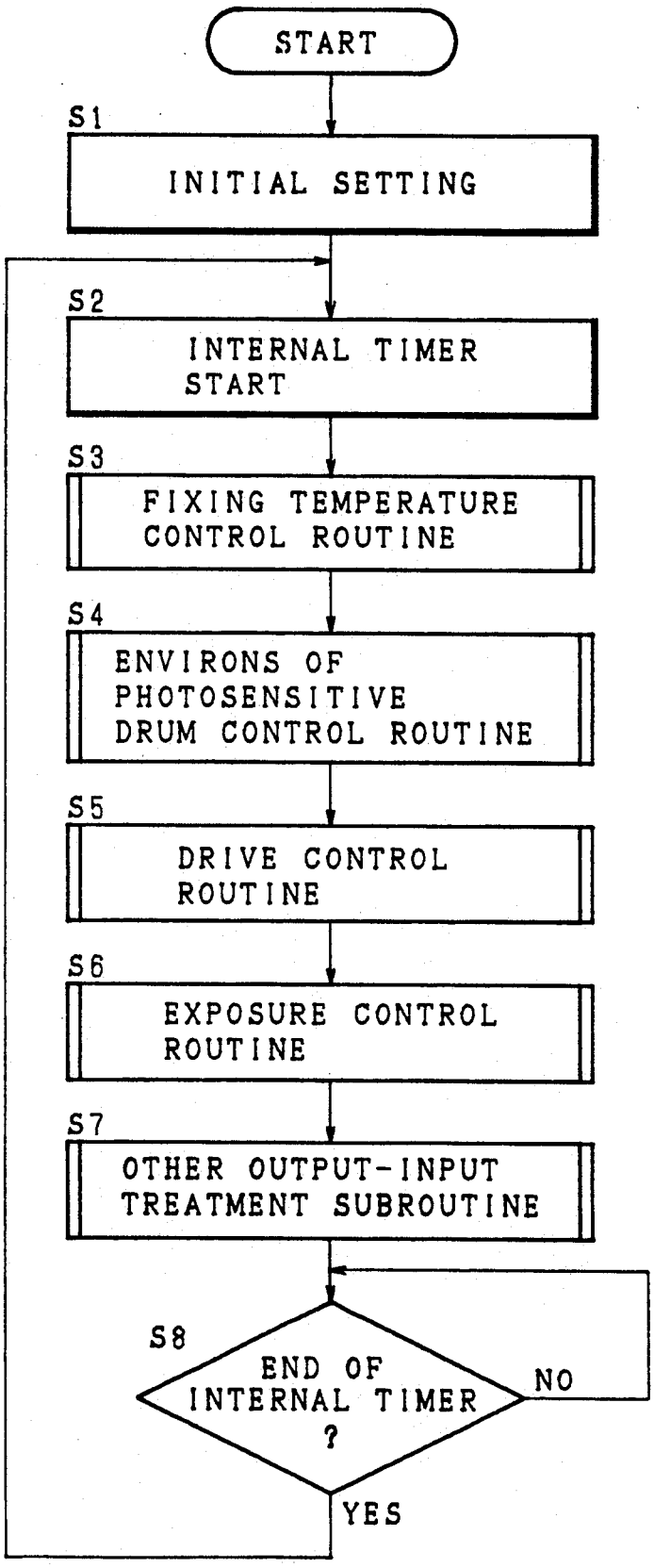
FIG. 3 and FIG. 4 are flow charts showing the control order for a CPU.
Figure 4:
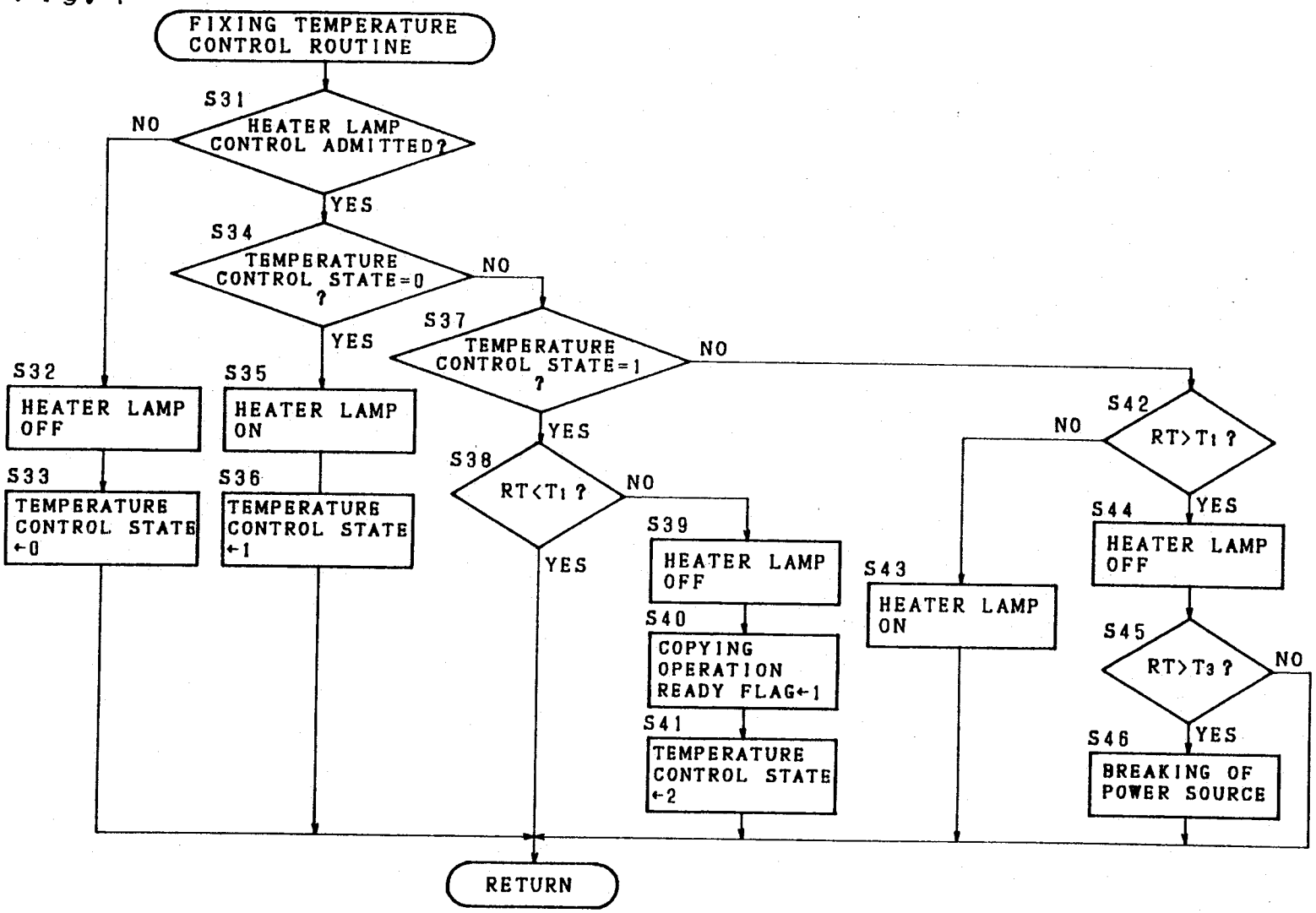

FIGS. 3 and 4 are flow charts showing control order for the CPU 200 as mentioned above. FIG. 3 shows the main flow of the operations of the CPU 200. The power source is turned on to allow the CPU 200 to reset, and the program starts. Firstly, at step S1 the initial setting is carried out in order to clear RAM (not shown in the drawings), initialize each register and put each device in the initial mode. Next, at step S2, an internal timer is started. This initial timer functions in order to determine the time required for one routine of the main routine irrespective of the contents treated in each sub-routine to be explained below. The value for it has been previously set at step S1.

Then, when sub-routines shown by steps S3 to S7 are called one by one, and the treatments in all sub-routines end, waiting for ending of said internal timer, at step S8, the process returns to step S2. Counting operations by timers used in each sub-routine are carried out on the basis of the time span required in this one routine.

Step S3 is a fixing temperature control routine in software as mentioned above, and its content will be described later with reference to the flow chart shown in FIG. 4.

Step S4 is a control routine for the environs of the photosensitive drum 1. Here controlling operations of chargers, the developing device 5 and the like are carried out. At next steps S5 and S6, driving-controlling operations of the main motor, rollers and the like and scanning-controlling of the image exposure device 3 are carried out.

FIG. 4 shows an example of the fixing temperature control routine. Actually, delicate temperature controls are done in accordance with the size and thickness of the paper, or circumstances whether the copying machine is in operation or in a ready state, for example. Here a control to maintain the fixing temperature at a first set point $T_1$ will be shown in view of the important regard in the present invention. At step S31, whether the fixing heater lamp 20 is at a state where its control may be admitted or not is discriminated. Such a signal for discrimination is emitted in other proper subroutine.

If the control of the fixing heater lamp 20 is not admitted at step S31, the fixing heater lamp 20 is turned off at step S32, that is, the output port $b_1$ of the CPU 200 is caused to be at a high level. At the next step S33 the temperature control state is reset (=0) and the process returns to the main routine. If the control of the fixing heater lamp 20 is admitted, this temperature control state is set to the value 1 or the value 2 according to the control state.

If the control of the fixing heater lamp 20 is admitted at step S31, the content of said temperature control state is checked at steps S34 and S37. In the case where the temperature control state takes the value 0, the fixing heater lamp 20 is turned on at step S35, and the temperature control state is set to the value 1 at step S36, and the process returns to the main routine. When the temperature control state comes to be at the value 1, the temperature RT of the upper fixing roller 151 detected by the thermister 16 is compared with a first set point $T_1$ at step S38. In the case where RT is lower than $T_1$, the process returns to the main routine, and the fixing heater lamp 20 continues lighting. If RT is not less than $T_1$, the fixing heater lamp 20 is turned off at step S39. After a copying operation ready flag is set at next step S40, the temperature control state is set to the value 2 at step S41 and the process returns to the main routine. Said copying operation ready flag is a flag which indicates that the machine is at a state where the copying operation is possible as the temperature of the upper fixing roller 151 is at a prescribed point ($T_1$). In accordance with this flag, treatments such as lightening a print switch in green on the operation panel of the machine, for example, are carried out in other sub-routines. Then, receiving an order to copy the document starts.

Next, when the temperature control state comes to be at the value 2, the temperature RT is compared with a first set point $T_1$ at step S42. If RT is not more than $T_1$, the fixing heater lamp 20 is turned on at step S43, and the process returns to the main routine. If RT is higher than $T_1$, the fixing heater lamp 20 is turned off at step S44. Next, RT is compared with an abnormality-detecting temperature $T_3$ at (next) step S45. If RT is not more than $T_3$, the process likewise returns to the main routine to keep the temperature RT at a first set point $T_1$. Here if RT is higher than $T_3$ at step S45, the breaking of the current from the power source 250 at next step S46. As mentioned above, this breaking operation is carried out by allowing the output port $b_2$ of the CPU 200 to be at a low level and the power relay 284 to be off. The abnormality-detecting temperature $T_3$ is set at 250° C., for example. If a second set point $T_2$ which corresponds to the voltage B of the comparator 230 is set at a value lower than 250° C., the AND circuit 271 outputs a low level before the CPU 200 gives an instruction, as a matter of course, and the breaking of the current from the power source is carried out.

The temperature control state at the fixing roller as mentioned above is explained with reference to the graphs shown in FIGS. 5 and 6. In both figures, the horizontal line denotes time, and the vertical line the temperature of the fixing roller. As mentioned above, signals $T_1$ (=170° C.) and $T_3$ (=250° C.) denote the fixing control temperature and an abnormality-detecting temperature respectively by the CPU 200, while signals $T_2$ (=250°±α° C.) and $T_4$ (=300° C.) denote a breaking temperature of the current from the power source by the breaking circuit of the current from the power source and the melting temperature of the temperature fuse 260 respectively.

Figure 5:
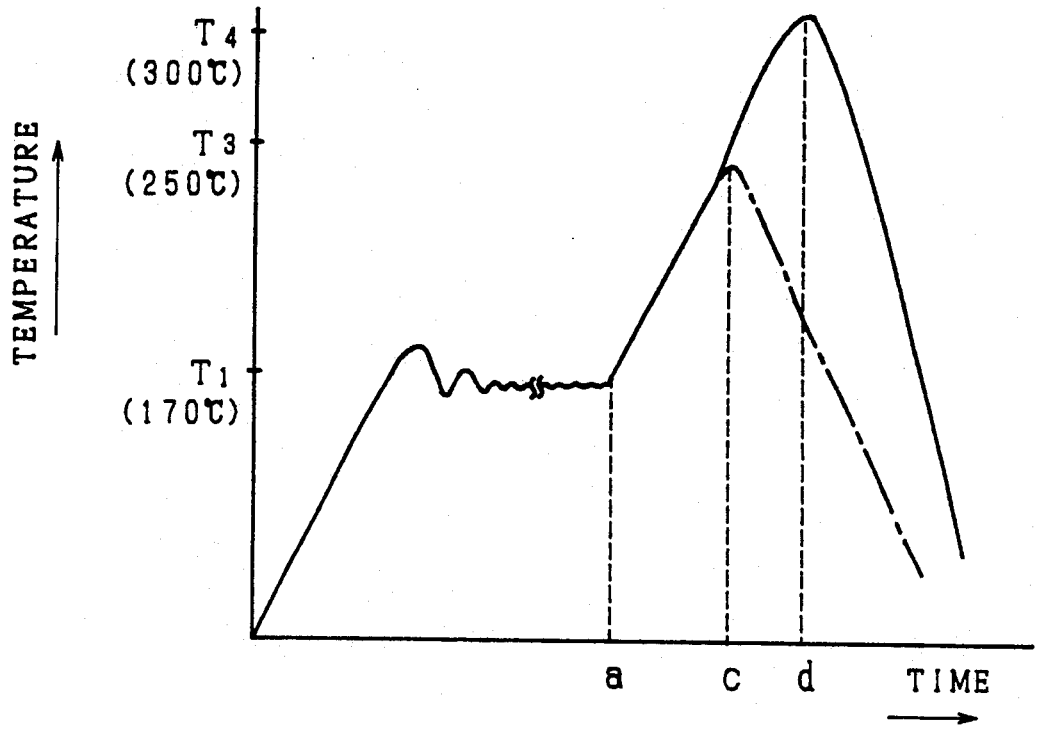
FIG. 5 and FIG. 6 are graphs showing the temperature control state at the fixing unit of the apparatus according to the present invention.

FIG. 5 shows the temperature control by a conventional CPU 200 alone. When some trouble happens at the stage a to cause the fixing heater lamp 20 to remain lighting during a temperature control operation at $T_1$, the temperature of the fixing roller continues increasing. And when the CPU 200 normally operates, the power source 250 is broken at the stage c where the temperature of the fixing roller reaches the abnormality-detecting temperature $T_3$, as shown by one-dotted chain line.

On the other hand, if the output port $b_1$ is latched at a low level due to the CPU 200 getting out of order, the breaking of the current from the power source is not carried out at the abnormality-detecting temperature $T_3$. Only at the stage d where the temperature of the fixing roller reaches $T_4$, the temperature fuse 260 is disabled and the temperature of the fixing roller decreases. Fires or the like can be prevented finally by the temperature fuse being disabled in this way. But damages of the surrounding parts as a result of heating are serious, and such parts must be replaced.

Figure 6:
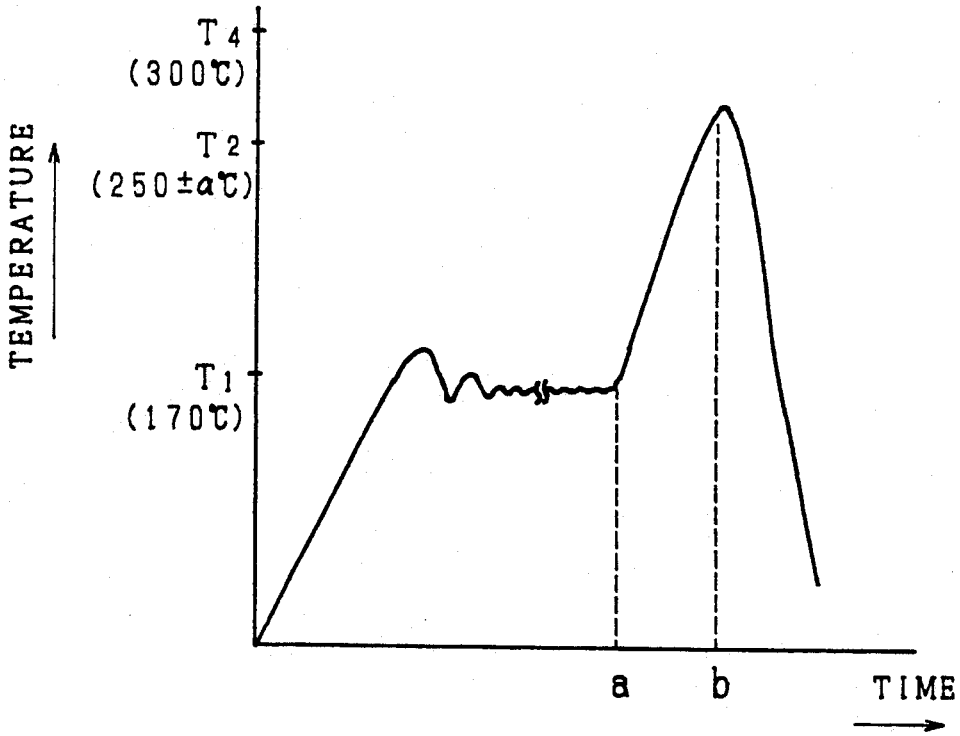

FIG. 6 shows the temperature control in the apparatus according to the present invention. If the output port $b_1$ is latched at a low level due to the CPU 200 getting out of order at the stage a during a temperature control operation at $T_1$ in the same way, the temperature of the fixing roller begins to increase. But at the stage b where the temperature of the fixing roller reaches $T_2$, the breaking of the current from the power source is carried out to turn off the fixing heater lamp 20 and the temperature of the fixing roller decreases. If the temperature $T_2$ is set at a very low point, the breaking of the current from the power source is carried out even when the CPU 200 normally carries out its control operations, because of an over-shoot, for example, due to the thermal time constant of the fixing roller or the reactivity of the thermister. For the prevention of this, the temperature $T_2$ is set at a point near 250° C. which is the abnormality-detecting temperature $T_3$ by the CPU 200. Moreover, according to such a construction, the breaking of the current from the power source can be carried out without fail by the breaking circuit of the current from the power source even when the CPU 200 getting out of order and a short-mode trouble in the SSR 220 combine to cause the fixing heater lamp 20 to remain turned on, and the increase in temperature is prevented.

In this embodiment, a thermister is used for detecting the temperature of the fixing roller. However, it should not be limited to such, and a detecting element such as a current collecting type infrared sensor or the like may also be used. The circuit arrangement should not be limited to this embodiment, either. Other circuit arrangements capable of carrying out similar operations may also be used.

As mentioned above, in the apparatus according to the present invention, the temperature control operation at the fixing unit can be done normally precisely by the processor. And if the fixing heater lamp is caused to remain turned on due to the processor getting out of order because of noises or the like, the breaking of the current from the power source at the fixing unit is carried out by the breaking circuit of the current from the power source at a point higher than the control temperature by the processor, for example, near the abnormality-detecting temperature at the time of normal control operation by the processor. Consequently, the temperature of the fixing unit will not continue increasing up to the point where the temperature fuse is disabled as conventionally, and that the parts may suffer from thermal damages can be prevented.

Next, another embodiment of the present invention will be described.

In this embodiment of the invention, the copying machine includes a fixing device which includes the upper fixing roller 151, the lower fixing roller 152, and the heater lamp 20. The fixing device fixes a toner image on a sheet. A detector or thermistor 16 detects an abnormal operation of the fixing device. A reset circuit which includes an AND circuit 210 automatically generates a reset signal or an output signal when the detector detects the abnormal operation of the fixing device. Preferably, the reset circuit automatically generates the reset signal when the detector detects a predetermined temperature. The reset signal is applied to the reset port of a processor or CPU 200 which controls the temperature of the fixing device. The processor includes an initializing function (S1) for initializing a control status thereof in response to a power-on of the copying machine. There is also a control program (S3) which includes a plurality of temperature control steps (S31–S46) following after the initialization of the processor such that the temperature of the fixing device is kept at a predetermined temperature (T1). The processor first executes the initializing function in response to the reset signal automatically generated by the reset circuit. The processor then executes the control program after the initialization in response to the reset signal. The control program includes emergency stop steps (S45, S46) by which a power supply to the fixing device is cut off when the temperature of the fixing device is higher than a limit temperature (T3).

In this embodiment, the whole structure of the copying machine is the same as that shown in FIG. 1, and the control order for the processor is the same as that shown in FIGS. 3 and 4. So the description of them are omitted.

Figure 7:
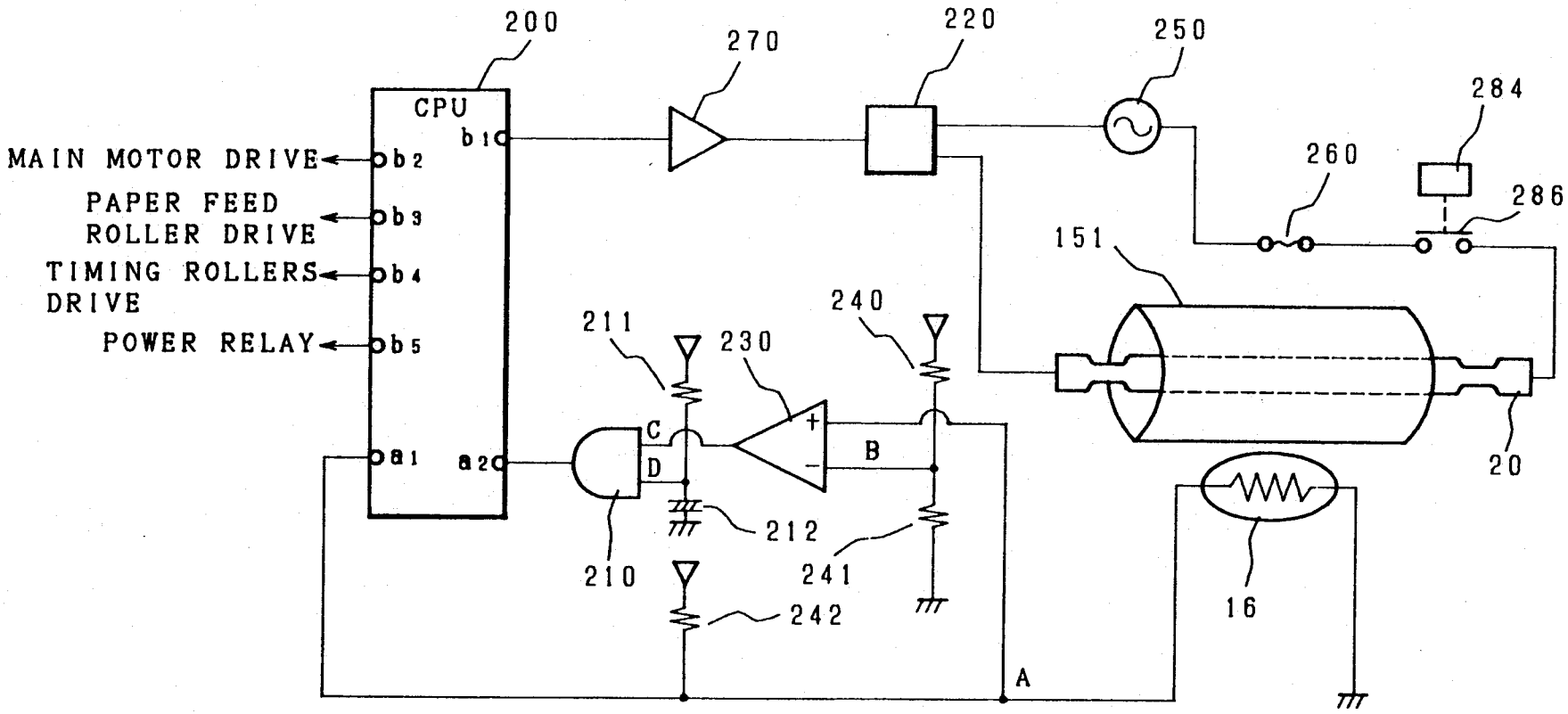
FIG. 7 is a block diagram of a principal part of the control circuits of another embodiment of the image forming apparatus according to the present invention.

FIG. 7 is a block diagram of a principal part of the control circuits of the image forming apparatus in this embodiment according to the present invention. The numeral 200 denotes a CPU which is the control nucleus, and an A/D converter is integrally formed therein. The intermediated potential at a voltage-dividing circuit is inputted in an analogue input port $a_1$ of the CPU 200 and a non-reverse input terminal of a comparator 230 respectively as the detecting signal A of the thermister 16. Into said voltage-dividing circuit, connected are a resistor 242 on the power source side and said thermister 16 on the ground side. A prescribed voltage B divided by resistors 240 and 241 is applied to a reverse input terminal of the comparator 230. The voltage B corresponds to a prescribed temperature of the upper fixing roller 151 which will be described later, that is, $T_2$ which is a temperature at a level higher (hereinafter called a second set point) than a fixing control temperature (hereinafter called a first set point) $T_1$ through software loaded in the CPU 200.

An output signal of the comparator 230 is an input signal C on one side of an AND circuit 210, and an input signal D on the other side of the AND circuit 210 is divided by a resistor 211 and a condenser 212. The output signal of the AND circuit 210 is automatically inputted in an input port $a_2$ which is a reset terminal of the CPU 200 without the manual intervention of the copy machine operator or a service technician.

The output port $b_1$ of the CPU 200 is connected to the control terminal of the SSR 220 via the driving circuit 270, and the SSR 220 is connected between the power source 250 and the fixing heater lamp 20 so as to control the power source 250 for lightening the fixing heater lamp 20 built in said upper fixing roller 151 to be on or off. Between the power source 250 and the fixing heater lamp 20, connected are the temperature fuse 260 provided near the upper fixing roller 151 and the normally open contact 286 of the power relay 284. The temperature fuse 260 is provided for the prevention of occurrence of a fire or the like in a case where the temperature at the fixing unit 15 abnormally increases due to an unexpected accident, and its melting temperature is set at a higher point where the fuse will not be disabled at normal copying operation, for example, 300° C.

The normally open contact 286 is provided in order to break the current from the power source when the temperature at the fixing unit 15 rises due to the SSR 220 getting out of order.

To the output ports $b_2$, $b_3$ and $b_4$ connected is a driving circuit which is not shown in the drawings, which controls each driving operation of a main motor (not shown in the drawings) which carries out rotation-drivings of the photosensitive drum 1 by respective outputs, the paper feed roller 11 and the timing roller 13. An output port $b_5$ is connected to the power relay 284. Normally it is at a high level and makes the normally open contact 286 remain closed. It is constructed so that various signals relating to copying operations not shown in the drawings may be inputted in the CPU and outputted from it as well as the signals mentioned above.

In the control circuits as constructed in this way, at first, the input signal D of the AND circuit 210 is at a low level immediately after the power source of the copying machine is provided, while another input signal C is at a high level because the voltage of the detecting signal A of the thermister 16 applied to the non-reverse input terminal of the comparator 230 is higher than said voltage B applied to the reverse input terminal. That is, before the power source of the CPU is determined, the output signal of the AND circuit 210 is at a low level. The output signal of the AND circuit 210 is converted to be at a high level when the CPU 200 is caused to be at a reset state and said input signal D comes to be at a high level after the power source is determined.

When the CPU 200 comes to be in an operating state, the detecting signal A of the thermister 16 is converted to a digital value in the CPU 200. The temperature control at the fixing unit 15 is carried out by allowing the fixing heater lamp 20 to turn on or turn off, in order that this digital value may accord with the control target value. When the output port $b_1$ of the CPU 200 is at a low level, the SSR 220 is made to operate to turn on the fixing heater lamp 20. As mentioned above, the voltage B corresponding to a second set point $T_2$ is applied to the reverse input terminal of the comparator 230. This second set point $T_2$ is set at a point higher than the fixing control temperature in a normal state as when the copying machine is in the ready state or when the copying machine is in operation, that is, said first set point $T_1$. Therefore, in a normal state, the voltage of the detecting signal A of the thermister 16 which is inputted in the non-reverse input terminal of the comparator 230 is higher than said voltage B, so the output signal of the comparator 230 is at a high level. As an example $T_1$ is near 170° C. and $T_2$ near 250° C. That is, in a normal state, the temperature control at a first set point $T_1$, that is, at around 170° C. is carried out by the CPU 200.

If the CPU 200 gets out of order due to noises or the like to cause the output port $b_1$, to latch at a low level, the fixing heater lamp 20 remains lighting. And when the temperature rises to $T_2$, that is, near 250° C., the voltage of the detecting signal A of the thermister 16 comes to be lower than the voltage B applied to the reverse input terminal of the comparator 230. As a result, the output signal of the comparator 230, that is, the input signal C of the AND circuit 210, is at a low level and the output signal of the AND circuit 210 is also at a low level. As a result, the CPU 200 is allowed to reset, the output port $b_1$ is converted to a high level, and the SSR 220 is caused to be off. Therefore, the mixing heater lamp 20 is turned off.

At step S45 in FIG. 4, if RT is higher than $T_3$, the breaking of the current from the powder source 250 is carried out at next step S46. This breaking of the current, however, is carried out not by the SSR 220 but by causing the power relay 284 to be off with the output of the output port $b_5$ at a low level to allow the normally open contact 286 to be an open state.

The temperature control state in this embodiment is the same as that in the first embodiment as shown in FIG. 6.

When the output port $b_1$ is latched at a low level because of the CPU 200 getting out of order at the stage a during a temperature control operation at $T_1$, the temperature of the fixing roller begins to rise. At the stage b where the temperature reaches $T_2$, the CPU 200 is reset to return to the initial stage to turn off the fixing heater lamp 20, and the temperature of the fixing roller decreases. If the temperature $T_2$ is set at a very low point, the CPU is reset even when the CPU 200 normally carries out its control operations, because of an over-shoot, for example, due to the thermal time constant of the fixing roller or the reactivity of the thermister. For the prevention of this, the temperature $T_2$ is set at a point near 250° C. which is the abnormality-detecting temperature $T_3$ by the CPU 200. Moreover, according to such a construction, the CPU 200 returns to the initial state first to release the getting-out-of-order state, and then the breaking of the current from the power source is carried out by the detection of the abnormality-detecting temperature $T_3$ of the CPU 200 even when the CPU 200 getting out of order and a short-mode trouble in the SSR 220 combine to cause the fixing heater lamp 20 to remain turned on, and the increase in temperature is prevented.

In this embodiment, a thermister is used for detecting the temperature of the fixing roller. However, it should not be limited to such, and a detecting element such as a current collecting type infrared sensor or the like may also be used. The circuit arrangement should not be limited to this embodiment, either. Other circuit arrangements capable of carrying out similar operations may also be used.

As mentioned above, in the apparatus according to the present invention, the temperature control operation at the fixing unit can be done normally precisely by the processor. and if the fixing heater lamp is cause to remain turned on due to the processor getting out of order because of noises or the like, the processor is allowed to return to the initial stage at a point higher than the control temperature by the processor, for example, near the abnormality-detecting temperature in normal control operation of the processor, by hardware circuits. Consequently, the temperature of the fixing unit will not continue increasing up to the point where the temperature fuse is disabled as conventionally, and that the parts may suffer from thermal damages can be prevented. Moreover, the getting-out-of-order state of the processor is automatically released.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. An image forming apparatus comprising:

a fixing unit where a toner image supported onto a paper is heated and fixed thereon, a detector which detects the temperature of said fixing unit, a processor which assumes an initial stage in response to the power-on of the apparatus and thereafter starts to control the temperature of said fixing unit to keep it at a first set point in response to a detection signal inputted by said detector, and a reset circuit for automatically resetting said processor to the initial stage when said detector detects a temperature of a second set point which is higher than said first set point.

2. An image forming apparatus as set forth in claim 1, wherein said fixing unit has a heater lamp and the temperature of said fixing unit is controlled by switching said heater lamp on and off.

3. An image forming apparatus as set forth in claim 2, further comprising a switch for opening and closing a power source to the heater lamp, wherein said processor causes said switch to open to switch off said heater lamp when said detecting means detects a temperature at a third set point higher than said first set point.

4. An image forming apparatus as set forth in claim 3, further comprising a temperature fuse which is disabled at a fourth set point higher than said third set point.

5. An image forming apparatus as set forth in claim 1, further comprising a temperature fuse which is disabled at a third set point higher than said second set point.

6. An image forming apparatus as set forth in claim 1, wherein said detector is a thermistor.

7. An image forming apparatus comprising:

a fixing unit which fixes a toner image formed on a sheet member thereon;

a power source which supplies current to said fixing unit;

a processor which resets RAM and registers at an initial stage and thereafter starts to control the current supplied from the power source to maintain the temperature of said fixing unit at a predetermined temperature; and reset means for automatically resetting said processor to the initial stage when the temperature of said fixing unit rises to an abnormal temperature which is higher than said predetermined temperature.

8. An image forming apparatus as set forth in claim 7 further comprising means for detecting the temperature of said fixing unit and outputting a voltage representing a detected temperature, wherein said reset means includes a comparator which compares the voltage outputted from said detecting means with a voltage corresponding to the abnormal temperature.

9. An image forming apparatus comprising:

a fixing device which fixes a toner image on a sheet;

a detector which detects a temperature of said fixing device;

a reset circuit which automatically generates a reset signal when said detector detects an abnormal temperature; and a processor which controls the temperature of said fixing device, said processor including an initializing function for initializing a control status thereof in response to a power-on of the apparatus and a control program including a plurality of temperature control steps following after the initialization by which the temperature of the fixing device is kept at a predetermined temperature in response to a detection of said detector, said processor also executing said initializing function in response to the reset signal generated by said reset circuit.

10. The image forming apparatus as set forth in claim 9, wherein said processor executes said control program after the initialization in response to the reset signal.

11. The image forming apparatus as set forth in claim 10, wherein said control program includes emergency stop steps by which a power supply to said fixing device is cut off when the temperature of said fixing device is higher than a limit temperature.

12. The image forming apparatus as set forth in claim 11, wherein said limit temperature is lower than said abnormal temperature.

13. An image forming apparatus comprising:

fixing unit where a toner image supported onto a paper is heated and fixed thereon:

a detector which detects a temperature of said fixing unit and generating a detection signal representing the temperature of the fixing device;

a processor which assumes an initial stage in response to the power-on of the apparatus and thereafter starts a temperature control of said fixing unit so as to keep the temperature of the fixing unit at a first set point in response to the detection signal, said temperature control including an emergency stop function which stops a power supply to a fixing unit when said detector detects a temperature of a second set point which is higher than said first set point; and a reset circuit for automatically resetting said processor to the initial stage when said detector detects a temperature of a third set point which is higher than said second set point.

* * * * *